US012122578B2

(12) United States Patent
Hashimoto et al.

(10) Patent No.: US 12,122,578 B2
(45) Date of Patent: Oct. 22, 2024

(54) BUILDING BOARD PACKAGE AND METHOD FOR MANUFACTURING BUILDING BOARD PACKAGE

(71) Applicant: NICHIHA CORPORATION, Nagoya (JP)

(72) Inventors: Yudai Hashimoto, Nagoya (JP); Hiroaki Yamamoto, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 72 days.

(21) Appl. No.: 18/097,982

(22) Filed: Jan. 17, 2023

(65) Prior Publication Data

US 2023/0150739 A1 May 18, 2023

Related U.S. Application Data

(63) Continuation of application No. PCT/JP2021/031841, filed on Aug. 31, 2021.

(30) Foreign Application Priority Data

Sep. 30, 2020 (JP) ..... 2020-166200

(51) Int. Cl.
*B65D 57/00* (2006.01)
*B65B 55/00* (2006.01)
(Continued)

(52) U.S. Cl.
CPC ..... *B65D 57/002* (2020.05); *B65B 55/00* (2013.01); *B65D 81/05* (2013.01); *B65D 85/62* (2013.01)

(58) Field of Classification Search
CPC ..... B65D 57/002; B65D 81/05; B65D 85/62; B65D 81/03; B65D 81/02; B65D 85/46; B65B 55/00
(Continued)

(56) References Cited

U.S. PATENT DOCUMENTS

2008/0210139 A1* 9/2008 Watanabe ..... B65D 63/1009 206/499
2019/0358932 A1* 11/2019 Shimatani ..... E04C 2/52

FOREIGN PATENT DOCUMENTS

AU 2010203335 A1 2/2011
CA 2830055 A1 * 4/2014 ..... C04B 41/009
(Continued)

OTHER PUBLICATIONS

International Search Report for International Application No. PCT/JP2021/031841 (4 sheets, 2 sheets translation, 6 sheets total).

*Primary Examiner* — Rafael A Ortiz
(74) *Attorney, Agent, or Firm* — Kratz, Quintos & Hanson, LLP

(57) ABSTRACT

Provided are a building board package suitable to suppress generation of a gloss that could be caused as a result of pressing a coating film on the surface of a building board, and a method for manufacturing the building board package. A building board package X1 according to the present invention includes a first building board 10, and a packing sheet 20 stacked on top of the first building board 10. The first building board 10 has a first surface 11 on the packing sheet 20 side, and a second surface 12 opposite the first surface 11. The first surface 11 includes a first coating film surface 11A. The packing sheet 20 has a third surface 21 on the first building board 10 side, and a fourth surface 22 opposite the third surface 21. The third surface 21 is in contact with the first coating film surface 11A. An absolute value of a difference between a 60-degree gloss value of the first coating film surface 11A and a 60-degree gloss value of the third surface 21 is 3.0 or less, and an absolute value of a difference between an 85-degree gloss value of the first coating film surface 11A and an 85-degree gloss value of the third surface 21 is 3.0 or less. A method for manufacturing a building board package according to the present invention
(Continued)

includes the step of stacking the first building board 10 and the packing sheet 20 on top of each other such that the first coating film surface 11A and the third surface 21 are in contact with each other.

8 Claims, 8 Drawing Sheets

(51) Int. Cl.
*B65D 81/05* (2006.01)
*B65D 85/62* (2006.01)

(58) Field of Classification Search
USPC ..... 206/321
See application file for complete search history.

(56) References Cited

FOREIGN PATENT DOCUMENTS

| | | | |
|---|---|---|---|
| CN | 104675009 | * | 6/2015 |
| JP | H10-338262 | A | 12/1998 |
| JP | H11-278547 | A | 10/1999 |
| JP | 2005-041546 | A | 2/2005 |
| JP | 2010-082872 | A | 4/2010 |
| JP | 2011-025989 | A | 2/2011 |

* cited by examiner

[Fig.1]
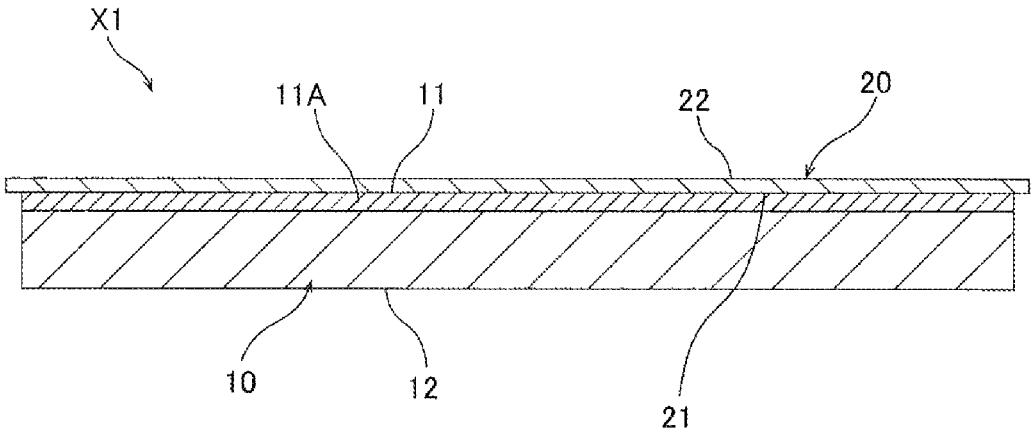

[Fig.2]
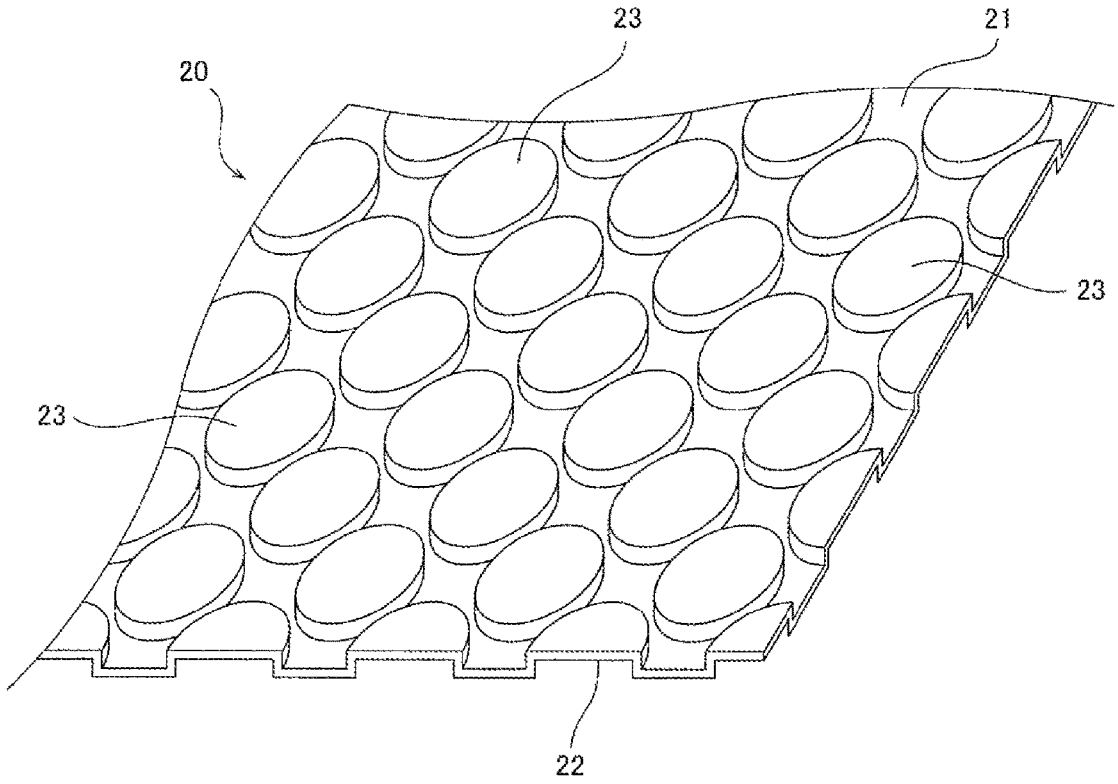

[Fig.3]
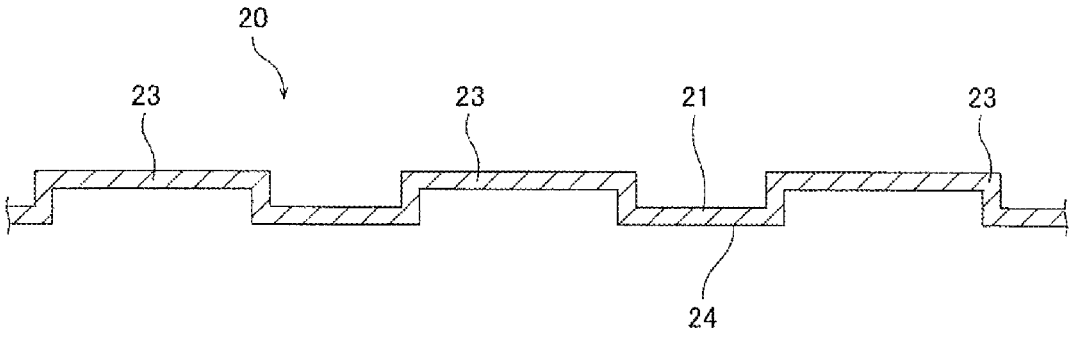

[Fig.4]
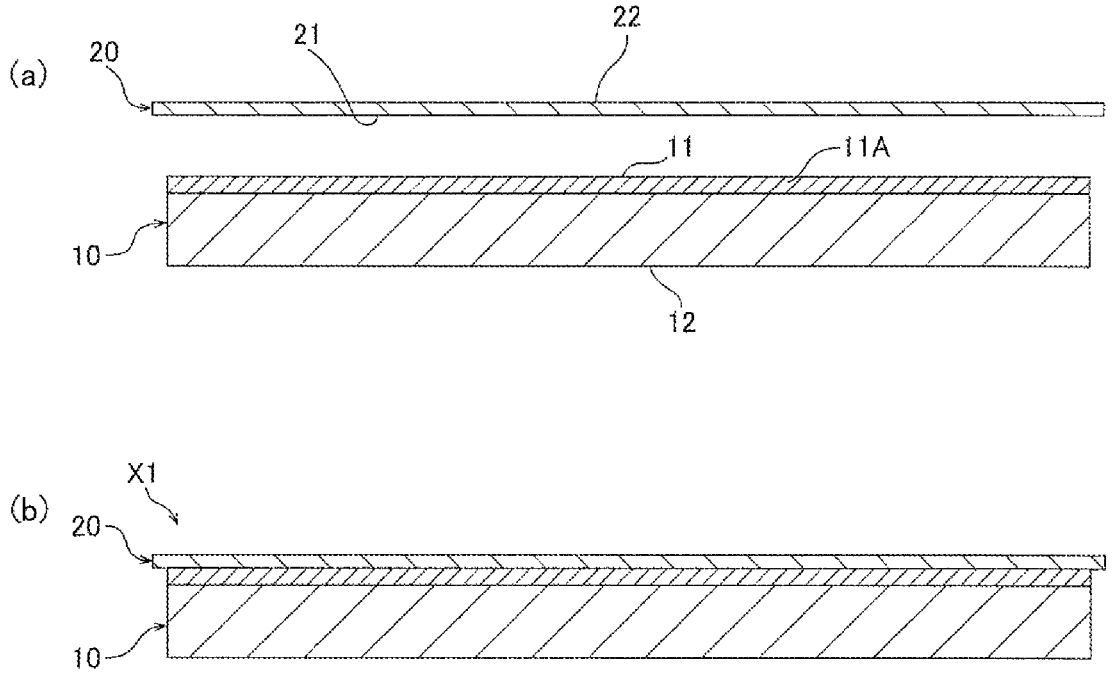

[Fig.5]
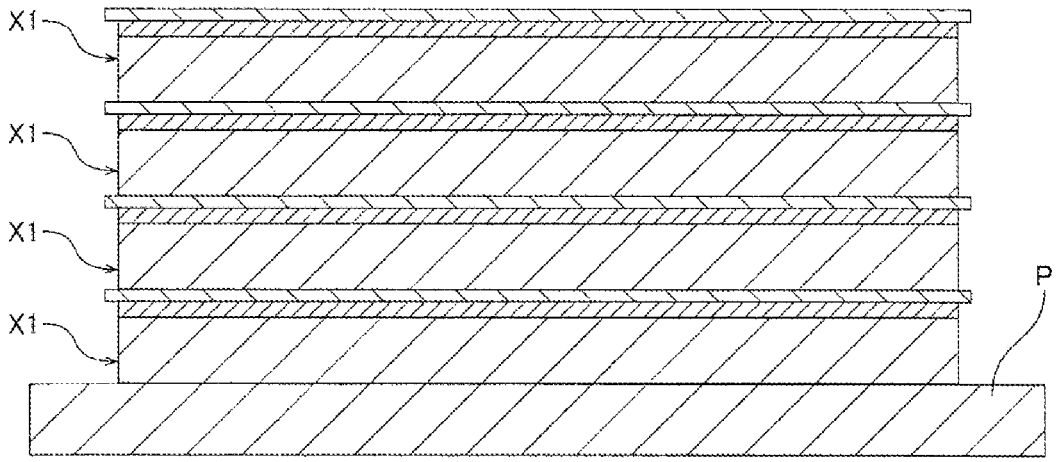

[Fig.6]
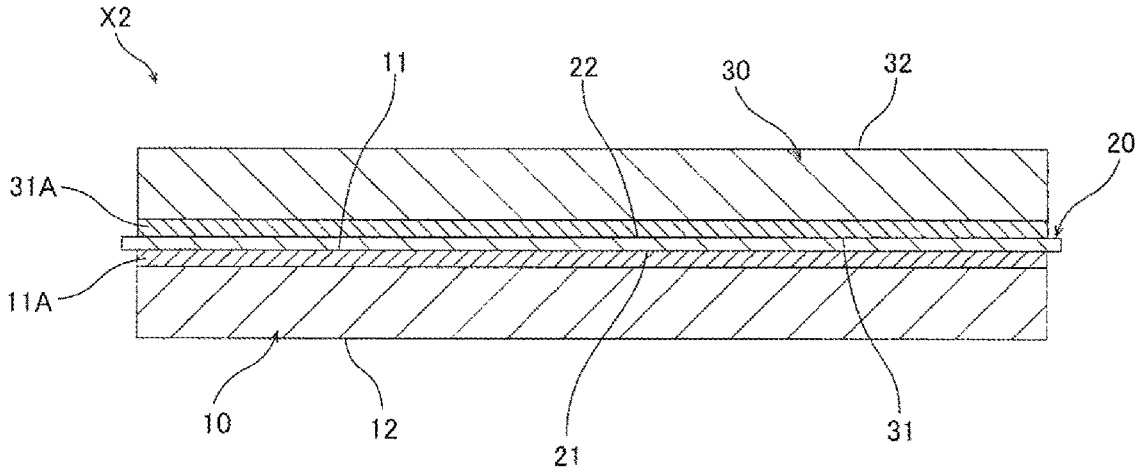

[Fig.7]
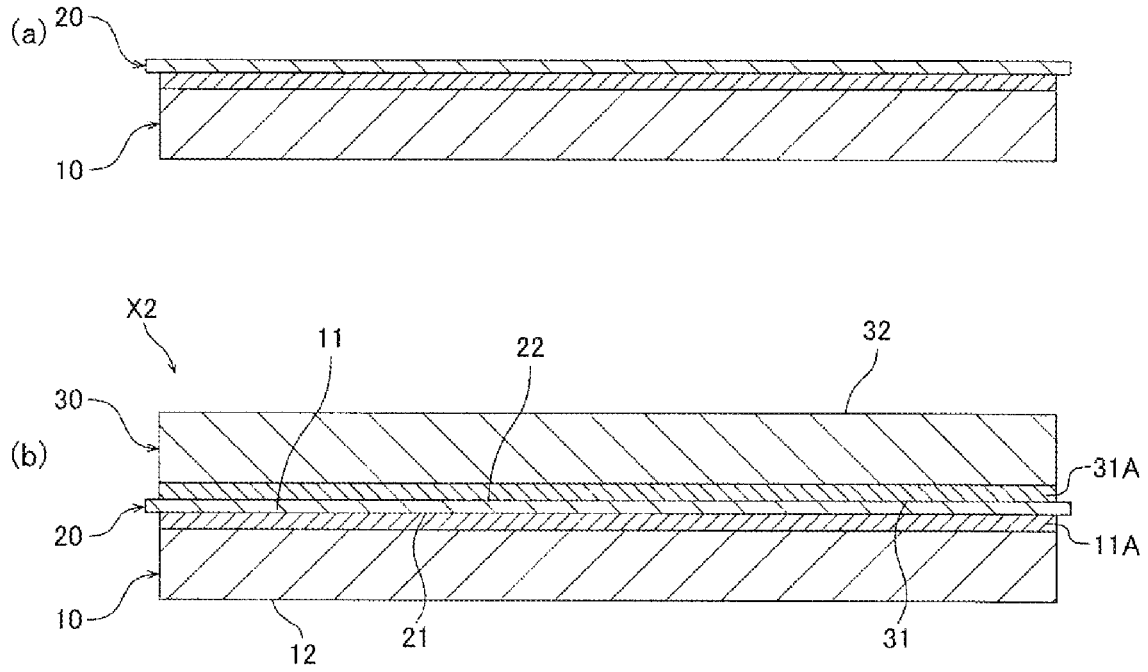

[Fig.8]
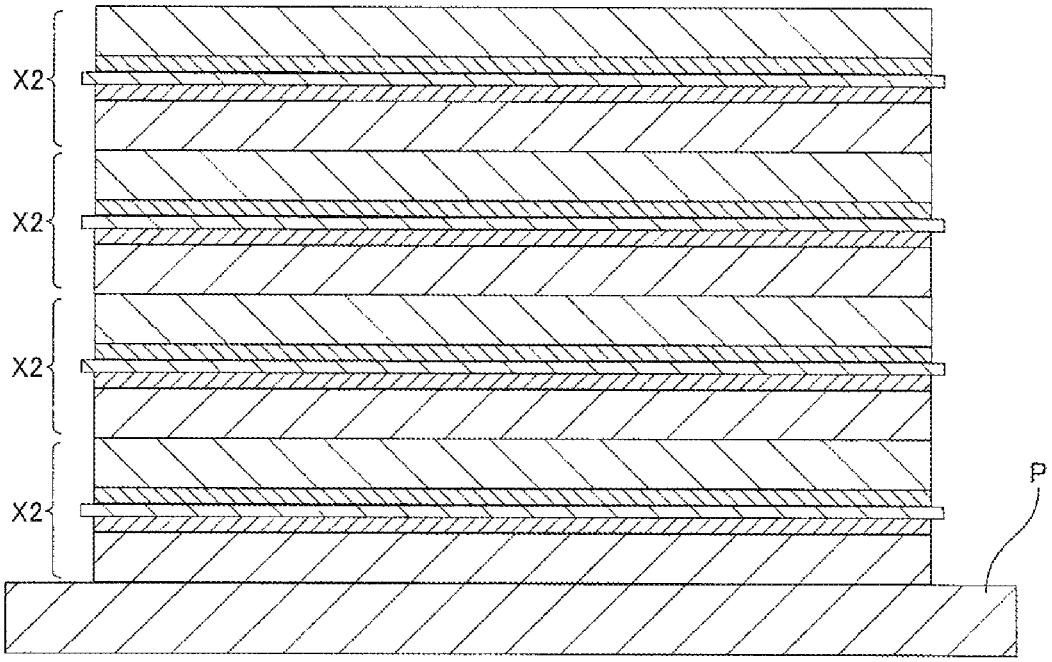

BUILDING BOARD PACKAGE AND METHOD FOR MANUFACTURING BUILDING BOARD PACKAGE

TECHNICAL FIELD

The present invention relates to a building board package, and a method for manufacturing the building board package.

BACKGROUND ART

For example, inorganic boards such as a ceramic siding board and a ceramic board are used as building boards constituting exterior walls and interior walls of buildings. To install a wall portion using building boards, a plurality of building boards are joined together in a vertical direction and a horizontal direction. Frequently, such building boards are packed into packages each including a predetermined number of building boards, and the packages are transported and stored while being stacked on a transport pallet. As for a technique relating to packaging of such building boards, for example, Patent Document 1 below describes protecting the surface of a coating film of a building board by a thin sheet, called a packing sheet.

CITATION LIST

Patent Document

Patent Document 1: JP 2005-41546A

SUMMARY OF INVENTION

Technical Problem

A building board may have coating applied to its design surface. When a coating film on the coated surface of a building board to which coating has been applied is pressed, the texture of the surface of the coating film may change at the pressed portion, thus generating a new gloss (i.e., the pressed portion may have a net outside light reflectance higher than that of an unpressed portion adjacent thereto). This is presumably because, on the surface of the coating film, a microscopic roughness profile corresponding to a predetermined texture is microscopically deformed (planarized) through pressing. For building boards and building board packages (hereinafter abbreviated as packages) that are stacked in multiple tiers on a transport pallet, an unintended new gloss on a coating film is likely to be particularly generated in a building board that is located in the lowermost tier and is subjected to the greatest load.

When a building board in which the above-described gloss resulting from pressing of the coating film is included in building boards constituting an exterior wall or an interior wall, the gloss may become noticeable depending on the irradiation angle of irradiation light such as sunlight and illumination light, thus impairing the appearance of the exterior wall or the interior wall. In particular, when the coating film on the surface of the building board is a matte coating film, the above-described unintended gloss is likely to be noticeable, and may impair the appearance of the exterior wall or the interior wall.

The present invention has been conceived under the above-described circumstances, and an object thereof is to provide a package suitable to suppress generation of a gloss that could be caused as a result of pressing a coating film on the surface of a building board, and a method for manufacturing the package.

Solution to Problem

According to a first aspect of the present invention, a package is provided. The package includes a first building board, and a packing sheet stacked on top of the first building board. The first building board has a first surface including a first coating film surface, and a second surface opposite the first surface. The packing sheet has a third surface on the first building board side, and a fourth surface opposite the third surface. The third surface is in contact with the first coating film surface. An absolute value of a difference between a 60-degree gloss value of the first coating film surface and a 60-degree gloss value of the third surface is 3.0 or less, and an absolute value of a difference between an 85-degree gloss value of the first coating film surface and an 85-degree gloss value of the third surface is 3.0 or less.

In the present package, the first coating film surface and the third surface that are in contact with each other have microscopic roughness profiles corresponding to their respective glosses. The further the values of both a difference in gloss value between the first coating film surface and the third surface when measuring a gloss value at a relatively small incident angle of 60 degrees in a gloss value measurement, and a difference in gloss value between the first coating film surface and the third surface when measuring a gloss value at a relatively large incident angle of 85 degrees in a gloss value measurement are below 3.0, the more closely the microscopic roughness profile of the first coating film surface and the microscopic roughness profile of the third surface resemble each other.

For such a package, even if the first coating film surface of the first building board is pressed by the third surface of the packing sheet and deformed microscopically, the deformation is caused by the microscopic roughness profile of the third surface that resembles the pre-deformation microscopic roughness profile of the pressed portion (e.g., the microscopic roughness profile of the third surface is transferred to the first coating film surface). Therefore, at the pressed portion of the first coating film surface, the change in texture is suppressed and a new gloss is less likely to be generated.

As described thus far, the package according to the first aspect of the present invention is suitable to suppress generation of a gloss that could be caused as a result of pressing a coating film on a surface of a building board.

Preferably, the package according to the present invention further includes a second building board stacked on top of the first building board with the packing sheet interposed between the second building board and the first building board. The second building board has a fifth surface on the first building board side, and a sixth surface opposite the fifth surface. The fifth surface includes a second coating film surface. The fourth surface of the packing sheet on the second building board side is in contact with the second coating film surface. An absolute value of a difference between a 60-degree gloss value of the second coating film surface and a 60-degree gloss value of the fourth surface is 3.0 or less, and an absolute value of a difference between an 85-degree gloss value of the second coating film surface and an 85-degree gloss value of the fourth surface is 3.0 or less.

In such a configuration, the second coating film surface and the fourth surface that are in contact with each other in the second building board and the packing sheet have microscopic roughness profiles corresponding to their respective glosses. The further the values of both a difference in gloss value between the second coating film surface and the fourth surface when measuring a gloss value at a relatively small incident angle of 60 degrees in a gloss value measurement, and a difference in gloss value between the second coating film surface and the fourth surface when measuring a gloss value at a relatively large incident angle of 85 degrees in a gloss value measurement are below 3.0, the more closely the microscopic roughness profile of the second coating film surface and the microscopic roughness profile of the fourth surface resemble each other. For such a package, even if the second coating film surface of the second building board is pressed by the fourth surface of the packing sheet and deformed microscopically, the deformation is caused as a result of the microscopic roughness profile of the fourth surface that resembles the pre-deformation microscopic roughness profile of the pressed portion being transferred to the second coating film surface, for example. Therefore, at the pressed portion of the second coating film surface, the change in texture is suppressed and a new gloss is less likely to be generated.

In a preferred mode of the first aspect according to the present invention, the third surface of the packing sheet has a roughness profile in which a plurality of minute protrusions protruding to the first building board side are uniformly disposed. The configuration in which the minute protrusions are uniformly disposed on the third surface of the packing sheet is suitable for the minute protrusions to uniformly come into point contact with the first coating film of the first building board, and is suitable to efficiently disperse a pressing force applied when the first coating film surface of the first building board is pressed by the third surface of the packing sheet. Therefore, the configuration is suitable to suppress deformation of the pressed portion. Furthermore, all portions of the third surface of the packing sheet have a roughness profile that resembles the microscopic roughness profile of the first coating film surface of the first building board. Accordingly, even if the first coating film surface of the first building board is pressed by the third surface of the packing sheet and deformed microscopically, the deformation is caused as a result of the microscopic roughness profile of the third surface that resembles the pre-deformation microscopic roughness profile of the pressed portion being transferred to the first coating film surface, for example. Therefore, at the pressed portion of the first coating film surface, the change in texture is suppressed and a new gloss is less likely to be generated.

In a preferred mode of the first aspect according to the present invention, the third surface of the packing sheet has a roughness profile in which a plurality of minute protrusions protruding to the first building board side are uniformly disposed, and the fourth surface has a roughness profile in which a plurality of minute recesses are disposed at positions respectively corresponding to the plurality of minute protrusions. The configuration in which the minute protrusions are uniformly disposed on the third surface of the packing sheet is suitable for the minute protrusions to uniformly come into point contact with the first coating film of the first building board, and is suitable to efficiently disperse a pressing force applied when the first coating film surface of the first building board is pressed by the third surface of the packing sheet. Therefore, the configuration is suitable to suppress deformation of the pressed portion. In addition, the configuration in which the minute protrusions are uniformly disposed on the fourth surface of the packing sheet is suitable for the fourth surface of the packing sheet to uniformly come into point contact with the second coating film of the second building board, and is suitable to efficiently disperse a pressing force applied when the second coating film surface of the second building board is pressed by the fourth surface of the packing sheet. Therefore, the configuration is suitable to suppress deformation of the pressed portion. Furthermore, all portions of the third surface of the packing sheet have a roughness profile that resembles the microscopic roughness profile of the first coating film surface of the first building board. Accordingly, even if the first coating film surface of the first building board is pressed by the third surface of the packing sheet and deformed microscopically, the deformation is caused as a result of the microscopic roughness profile of the third surface that resembles the pre-deformation microscopic roughness profile of the pressed portion being transferred to the first coating film surface, for example. Therefore, at the pressed portion of the first coating film surface, the change in texture is suppressed and a new gloss is less likely to be generated. Furthermore, all portions of the fourth surface of the packing sheet have a roughness profile that resembles the microscopic roughness profile of the second coating film surface of the second building board. Accordingly, even if the second coating film surface of the second building board is pressed by the fourth surface of the packing sheet and deformed microscopically, the deformation is caused as a result of the microscopic roughness profile of the fourth surface that resembles the pre-deformation microscopic roughness profile of the pressed portion being transferred to the second coating film surface, for example. Therefore, at the pressed portion of the second coating film surface, the change in texture is suppressed and a new gloss is less likely to be generated.

According to a second aspect of the present invention, a method for manufacturing a package is provided. The manufacturing method includes a preparing step and a stacking step. In the preparing step, a first building board having a first surface including a first coating film surface and a second surface opposite the first surface, and a packing sheet having a third surface and a fourth surface opposite the third surface are prepared. In the stacking step, the first building board and the packing sheet are stacked on top of each other such that the first coating film surface and the third surface are in contact with each other. An absolute value of a difference between a 60-degree gloss value of the first coating film surface and a 60-degree gloss value of the third surface is 3.0 or less, and an absolute value of a difference between an 85-degree gloss value of the first coating film surface and an 85-degree gloss value of the third surface is 3.0 or less.

In the present manufacturing method, the first coating film surface of the first building board and the third surface of the packing sheet have microscopic roughness profiles. The further the values of both a difference in gloss value between the first coating film surface and the third surface when measuring a gloss value at a relatively small incident angle of 60 degrees in a gloss value measurement, and a difference in gloss value between the first coating film surface and the third surface when measuring a gloss value at a relatively large incident angle of 85 degrees in a gloss value measurement are below 3.0, the more closely the microscopic roughness profile of the first coating film surface and the microscopic roughness profile of the third surface resemble each other.

When the first coating film surface of the first building board and the third surface of the packing sheet that have microscopic roughness profiles resembling each other are stacked on top of each other so as to be in contact with each other, and the first coating film surface of the first building board is protected by the third surface of the packing sheet, even if the first coating film surface of the first building board is pressed by the third surface of the packing sheet and deformed microscopically, the deformation is caused as a result of the microscopic roughness profile of the third surface that resembles the pre-deformation microscopic roughness profile of the pressed portion being transferred to the first coating film surface, for example. Therefore, at the pressed portion of the first coating film surface, the change in texture is suppressed and a new gloss is less likely to be generated.

Preferably, the present manufacturing method further includes a step of stacking a second building board having a fifth surface including a second coating film surface, and a sixth surface opposite the fifth surface, on top of the first building board with the packing sheet interposed between the second building board and the first building board such that the second coating film surface and the fourth surface of the packing sheet are in contact with each other. An absolute value of a difference between a 60-degree gloss value of the second coating film surface and a 60-degree gloss value of the fourth surface is 3.0 or less, and an absolute value of a difference between an 85-degree gloss value of the second coating film surface and an 85-degree gloss value of the fourth surface is 3.0 or less.

In such a configuration, the second coating film surface and the fourth surface that are in contact with each other in the second building board and the packing sheet have microscopic roughness profiles corresponding to their respective glosses. The further the values of both a difference in gloss value between the second coating film surface and the fourth surface when measuring a gloss value at a relatively small incident angle of 60 degrees in a gloss value measurement, and a difference in gloss value between the second coating film surface and the fourth surface when measuring a gloss value at a relatively large incident angle of 85 degrees in a gloss value measurement are below 3.0, the more closely the microscopic roughness profile of the second coating film surface and the microscopic roughness profile of the fourth surface resemble each other. When the second coating film surface of the second building board and the fourth surface of the packing sheet that have microscopic roughness profiles resembling each other are stacked on top of each other so as to be in contact with each other, and the second coating film surface of the second building board is protected by the fourth surface of the packing sheet, even if the second coating film surface of the second building board is pressed by the fourth surface of the packing sheet and deformed microscopically, the deformation is caused as a result of the microscopic roughness profile of the fourth surface that resembles the pre-deformation microscopic roughness profile of the pressed portion being transferred to the second coating film surface, for example. Therefore, at the pressed portion of the second coating film surface, the change in texture is suppressed and a new gloss is less likely to be generated.

In a preferred mode of the first aspect according to the present invention, the third surface of the packing sheet has a roughness profile in which a plurality of minute protrusions protruding to the first building board side are uniformly disposed. The configuration in which the minute protrusions are uniformly disposed on the third surface of the packing sheet is suitable for the minute protrusions to uniformly come into point contact with the first coating film of the first building board, and is suitable to efficiently disperse a pressing force applied when the first coating film surface of the first building board is pressed by the third surface of the packing sheet. Therefore, the configuration is suitable to suppress deformation of the pressed portion. Furthermore, all portions of the third surface of the packing sheet have a roughness profile that resembles the microscopic roughness profile of the first coating film surface of the first building board. Accordingly, even if the first coating film surface of the first building board is pressed by the third surface of the packing sheet and deformed microscopically, the deformation is caused as a result of the microscopic roughness profile of the third surface that resembles the pre-deformation microscopic roughness profile of the pressed portion being transferred to the first coating film surface, for example. Therefore, at the pressed portion of the first coating film surface, the change in texture is suppressed and a new gloss is less likely to be generated.

In a preferred mode of the first aspect according to the present invention, the third surface of the packing sheet has a roughness profile in which a plurality of minute protrusions protruding to the first building board side are uniformly disposed, and the fourth surface has a roughness profile in which a plurality of minute recesses are disposed at positions respectively corresponding to the plurality of minute protrusions. The configuration in which the minute protrusions are uniformly disposed on the third surface of the packing sheet is suitable for the minute protrusions to uniformly come into point contact with the first coating film of the first building board, and is suitable to efficiently disperse a pressing force applied when the first coating film surface of the first building board is pressed by the third surface of the packing sheet. Therefore, the configuration is suitable to suppress deformation of the pressed portion. In addition, the configuration in which the minute protrusions are uniformly disposed on the fourth surface of the packing sheet is suitable for the fourth surface of the packing sheet to uniformly come into point contact with the second coating film of the second building board, and is suitable to efficiently disperse a pressing force applied when the second coating film surface of the second building board is pressed by the fourth surface of the packing sheet. Therefore, the configuration is suitable to suppress deformation of the pressed portion. Furthermore, all portions of the third surface of the packing sheet have a roughness profile that resembles the microscopic roughness profile of the first coating film surface of the first building board. Accordingly, even if the first coating film surface of the first building board is pressed by the third surface of the packing sheet and deformed microscopically, the deformation is caused as a result of the microscopic roughness profile of the third surface that resembles the pre-deformation microscopic roughness profile of the pressed portion being transferred to the first coating film surface, for example. Therefore, at the pressed portion of the first coating film surface, the change in texture is suppressed and a new gloss is less likely to be generated. Furthermore, all portions of the fourth surface of the packing sheet have a roughness profile that resembles the microscopic roughness profile of the second coating film surface of the second building board. Accordingly, even if the second coating film surface of the second building board is pressed by the fourth surface of the packing sheet and deformed microscopically, the deformation is caused as a result of the microscopic roughness profile of the fourth surface that resembles the pre-deformation microscopic roughness profile of the pressed portion being transferred to the second coating film surface, for example. Therefore, at the pressed portion of the second coating film surface, the change in texture is suppressed and a new gloss is less likely to be generated.

BRIEF DESCRIPTION OF DRAWINGS

FIG. 1 is a schematic cross-sectional view of a package according to a first embodiment of the present invention.

FIG. 2 is a partially enlarged perspective view of an example of a packing sheet.

FIG. 3 shows a cross-sectional view taken along the line III-III in FIG. 2.

FIG. 4 shows a method for manufacturing the package shown in FIG. 1.

FIG. 5 shows a case where the packages shown in FIG. 1 are stacked in multiple tiers on a pallet.

FIG. 6 is a schematic cross-sectional view of a building board package according to a second embodiment of the present invention.

FIG. 7 shows a method for manufacturing the package shown in FIG. 6.

FIG. 8 shows a case where the packages shown in FIG. 6 are stacked in multiple tiers on a pallet.

DESCRIPTION OF EMBODIMENTS

FIG. 1 is a schematic cross-sectional view of a package X1 according to a first embodiment of the present invention. The package X1 includes a first building board 10, and a packing sheet 20 stacked on top of the first building board 10.

The first building board 10 has a first surface 11 on the packing sheet 20 side, and a second surface 12 opposite the first surface 11. The first surface 11 includes a first coating film surface 11A.

The first coating film surface 11A can be formed, for example, by applying a coating material to the first surface 11, and drying the coating material, to form a coating film. Examples of the coating material include an acrylic resin coating material, a silicone-acrylic resin coating material, a silicone resin coating material, a fluororesin coating material, and a urethane resin coating material. The coating material may contain resin beads, a pigment, and a filler. The thickness of the coating film is 10 to 100 μm, for example. The first coating film surface 11A may have a layered structure including a plurality of resin films. For example, the first coating film surface 11A may have a layered structure including an undercoating film, an intermediate coating film, and a clear coating film in this order.

The packing sheet 20 includes a third surface 21 on the first building board 10 side, and a fourth surface 22 opposite the third surface 21. The third surface 21 is in contact with the first coating film surface 11A. Preferably, the third surface 21 has a roughness profile in which a plurality of minute protrusions protruding to the first building board 10 side are uniformly disposed.

The packing sheet 20 is a thin sheet that covers the first coating film surface 11A of the first building board 10 to protect the first coating film surface 11A. The packing sheet 20 may have any shape that can cover the first coating film surface 11A, and may be a single sheet, a stack of two or more sheets, or a tubular sheet. The packing sheet 20 may also be disposed so as to cover only the first coating film surface 11A, or may also be disposed so as to envelope the entire first building board 10.

Examples of the material constituting the packing sheet 20 include a resin film. Examples of the resin film include polyethylene, polypropylene, vinyl chloride, nylon, polyester, polyvinyl alcohol, an ethylene-vinyl acetate copolymer, and triacetate. The packing sheet 20 may be a laminate film of a plurality of resin films. The packing sheet 20 may also be a laminate of a resin film and cloth or paper.

The roughness profile of the packing sheet 20 can be formed by a method such as incorporation of inorganic or organic particles when manufacturing a packing sheet, transferring of the surface profile of a metal roll, physical embossing through spraying of sand or the like, and chemical etching.

The thickness of the packing sheet 20 is not particularly limited, but is preferably 40 to 500 μm for a resin film and a laminate film, and is preferably 100 to 500 μm for a laminate of a resin film and cloth or paper.

In the package X1, an absolute value of a difference between a 60-degree gloss value of the first coating film surface 11A and a 60-degree gloss value of the third surface 21 is 3.0 or less, and an absolute value of a difference between an 85-degree gloss value of the first coating film surface 11A and an 85-degree gloss value of the third surface 21 is 3.0 or less.

FIG. 4 shows a method for manufacturing the package X1. The manufacturing method includes a preparing step and a stacking step as described below.

In the preparing step, a first building board 10 having a first surface 11 including a first coating film surface 11A and a second surface 12 opposite the first surface 11, and a packing sheet 20 including a third surface 21 and a fourth surface 22 opposite the third surface 21 are prepared.

In the stacking step, the first building board 10 and the packing sheet 20 are stacked on top of each other such that first coating film surface 11A and the third surface 21 are in contact with each other. As described above, an absolute value of a difference between a 60-degree gloss value of the first coating film surface 11A and a 60-degree gloss value of the third surface 21 is 3.0 or less, and an absolute value of a difference between an 85-degree gloss value of the first coating film surface 11A and an 85-degree gloss value of the third surface 21 is 3.0 or less.

In the package X1, the first coating film surface 11A and the third surface 21 that are in contact with each other in the first building board 10 and the packing sheet 20 that are stacked on top of each other have microscopic roughness profiles corresponding to their respective glosses. The further the values of both a difference in gloss value between the first coating film surface and the third surface when measuring a gloss value at a relatively small incident angle of 60 degrees in a gloss value measurement, and a difference in gloss value between the first coating film surface and the third surface when measuring a gloss value at a relatively large incident angle of 85 degrees in a gloss value measurement are below 3.0, the more closely the microscopic roughness profile of the first coating film surface 11A and the microscopic roughness profile of the third surface 21 resemble each other.

For such a package X1, even if the first coating film surface 11A of the first building board 10 is pressed by the third surface 21 of the packing sheet 20 and deformed microscopically in a state in which the packages X1 are stacked in multiple tiers as shown in FIG. 5, for example, the deformation is caused by the microscopic roughness profile of the third surface 21 that resembles the pre-deformation microscopic roughness profile of the pressed portion (e.g., the microscopic roughness profile of the third surface 21 is transferred to the first coating film surface 11A). Therefore, at the pressed portion of the first coating film surface 11A, the change in texture is suppressed and a new gloss is less likely to be generated. FIG. 5 illustratively shows a state in which packages X1 are stacked in four tiers on a pallet P.

As described thus far, the package X1 is suitable to suppress generation of a gloss that could be caused as a result of pressing a coating film on a surface of a building board.

Preferably, as described above, the third surface 21 has a roughness profile that includes a plurality of minute protrusions protruding to the first building board 10 side and in which the minute protrusions are uniformly disposed. Such a configuration is suitable to efficiently disperse a pressing force applied when the first coating film surface 11A of the first building board 10 is pressed by the third surface 21 of the packing sheet 20, and is therefore suitable to suppress deformation of the pressed portion.

FIG. 6 is a schematic cross-sectional view of a package X2 according to a second embodiment of the present invention. The package X2 includes a first building board 10, a packing sheet 20, and a second building board 30. The package X2 is different from the above-described package X1 in that the package X2 further includes the second building board 30.

The second building board 30 has a fifth surface 31 on the first building board 10 side, and a sixth surface 32 opposite the fifth surface 31, and is stacked on top of the first building board 10 with the packing sheet 20 interposed between the second building board 30 and the first building board 10. The fifth surface 31 includes a second coating film surface 31A.

In the present embodiment, the fourth surface 22 of the packing sheet 20 on the second building board 30 side is in contact with the second coating film surface 31A. In the present embodiment, the third surface 21 of the packing sheet 20 has a roughness profile that includes a plurality of minute protrusions protruding to the first building board 10 side and in which the minute protrusions are uniformly disposed, and the fourth surface 22 has a roughness profile including a plurality of minute recesses at positions respectively corresponding to the plurality of minute protrusions.

In the package X2, an absolute value of a difference between a 60-degree gloss value of the second coating film surface 31A and a 60-degree gloss value of the fourth surface 22 is 3.0 or less, and an absolute value of a difference between an 85-degree gloss value of the second coating film surface 31A and an 85-degree gloss value of the fourth surface 22 is 3.0 or less.

FIG. 7 shows a method for manufacturing such a package X2. The manufacturing method includes the above-described preparing step, the above-described stacking step (a first stacking step), and a stacking step (a second stacking step) as shown in FIG. 7.

In the second stacking step, a second building board 30 having a fifth surface 31 including a second coating film surface 31A and a sixth surface 32 opposite the fifth surface 31 is stacked on top of the first building board 10 with the packing sheet 20 interposed between the second building board 30 and the first building board 10 such that the second coating film surface 31A and the fourth surface 22 of the packing sheet 20 are in contact with each other. As described above, an absolute value of a difference between a 60-degree gloss value of the second coating film surface 31A and a 60-degree gloss value of the fourth surface 22 is 3.0 or less, and an absolute value of a difference between an 85-degree gloss value of the second coating film surface 31A and an 85-degree gloss value of the fourth surface 22 is 3.0 or less.

In the package X2 manufactured in this manner, the second coating film surface 31A and the fourth surface 22 that are in contact with each other in the second building board 30 and the packing sheet 20 have microscopic roughness profiles corresponding to their respective glosses. The further the values of both a difference in gloss value between the second coating film surface 31A and the fourth surface 22 when measuring a gloss value at a relatively small incident angle of 60 degrees in a gloss value measurement, and a difference in gloss value between the second coating film surface 31A and the fourth surface 22 when measuring a gloss value at a relatively large incident angle of 85 degrees in a gloss value measurement are below 3.0, the more closely the microscopic roughness profile of the second coating film surface 31A and the microscopic roughness profile of the fourth surface 22 resemble each other.

For such a package X2, even if the second coating film surface 31A of the second building board 30 is pressed by the fourth surface 22 of the packing sheet 20 and deformed microscopically in a state in which the packages X2 are stacked in multiple tiers as shown in FIG. 8, for example, the deformation is caused by the microscopic roughness profile of the fourth surface 22 that resembles the pre-deformation microscopic roughness profile of the pressed portion. Therefore, at the pressed portion of the second coating film surface 31A, the change in texture is suppressed and a new gloss is less likely to be generated. FIG. 8 illustratively shows a state in which the packages X2 are stacked in four tiers on a pallet P.

The package X2 provides the foregoing technical effect in addition to the above-described technical effect relating to the package X1.

In the packing sheet 20 of the present embodiment, as described above, the third surface 21 has a roughness profile that includes a plurality of minute protrusions protruding to the first building board 10 side and in which the minute protrusions are uniformly disposed, and the fourth surface 22 has a roughness profile that includes a plurality of minute recesses at positions respectively corresponding to the plurality of minute protrusions. Such a configuration is suitable to efficiently disperse a pressing force applied when the first coating film surface 11A of the first building board 10 is pressed by the third surface 21 of the packing sheet 20, or when the second coating film surface 31A of the second building board 30 is pressed by the fourth surface 22 of the packing sheet 20, and is therefore suitable to suppress deformation of the pressed portion.

EXAMPLES

Example 1

Production of Building Board

First, an acrylic coating material was applied to a flat patterned design surface of an inorganic board (1820 mm×470 mm×16 mm, 17 kg), and was then dried, to form an intermediate coating film having a thickness of 20 μm. Next, a silicone-acrylic coating material containing resin beads was applied onto the intermediate coating film, and was then dried, to form a matte clear coating film having a thickness of 10 μm. In the above-described manner, two building boards B1 each including a matte clear coating film on one surface thereof were produced.

Production of Package

First, a packing sheet S1 (thickness: 50 μm, a polyethylene film) was placed such that a back surface of the packing sheet S1 faced and contacted the matte clear coating film of one building board B1. The packing sheet S1 had been subjected to embossing, and has, on a front surface thereof, a roughness profile including a plurality of minute protrusions (uniformly disposed) formed through the embossing, and has, on a back surface thereof, a roughness profile including a plurality of minute recesses at position respectively corresponding to the plurality of minute protrusions. On the front surface of the packing sheet S1, minute protrusions each having a top surface with an ellipsoidal shape of 310×410 μm and having a height of 42 μm are disposed substantially equidistantly in a zig-zag pattern, thus forming uniform roughness. On the back surface of the packing sheet S1, minute recesses each having a bottom surface with an ellipsoidal shape of 310×410 μm and having a depth of 38 μm are disposed substantially equidistantly in a zig-zag pattern at positions respectively corresponding to the plurality of minute protrusions, thus forming uniform roughness. Next, the other building board B1 was stacked on top of the one building board B1 with the packing sheet S1 interposed between the other building board B1 and the one building board B1. The other building board B1 was placed such that the matte clear coating film thereof faced and contacted the other surface of the packing sheet S1. In the above-described manner, a package having the same stacked configuration as that shown in FIG. 6 was produced.

Example 2 and Comparative Examples 1 and 2

Packages of Example 2 and Comparative Examples 1 and 2 were produced in the same manner as in the case of the package of Example 1 except that a packing sheet S2 (Example 2), a packing sheet S3 (Comparative Example 1) or a packing sheet S4 (Comparative Example 2) was used in place of the packing sheet S1.

The packing sheet S2 is a packing sheet (thickness: 80 μm, a polyethylene film) having a textured pattern formed through embossing. The packing sheet S2 has, on a front surface thereof, a textured pattern (including a plurality of minute protrusions that are uniformly disposed) as a roughness profile formed through the embossing, and has, on a back surface thereof, a roughness profile including a plurality of minute recesses at positions respectively corresponding to the plurality of minute protrusions.

The packing sheet S3 is a packing sheet (thickness: 56 μm, a calcium carbonate fine particle-containing polyethylene film) containing fine particles of calcium carbonate.

The packing sheet S4 is a packing sheet (thickness: 200 μm) obtained by laminating both surfaces of kraft paper with a polyethylene resin.

Example 3

Production of Building Board

First, an acrylic coating material was applied to a brick patterned design surface of an inorganic board (1820 mm×470 mm×16 mm, 17 kg), and was then dried, to form an intermediate coating film having a thickness of 50 μm. Next, a silicone-acrylic coating material containing resin beads was applied onto the intermediate coating film, and was then dried, to form a matte clear coating film having a thickness of 40 μm. In the above-described manner, two building boards B2 each including a matte clear coating film on one surface thereof were produced.

Production of Package

A packing sheet S1 (thickness: 50 μm, a polyethylene film) was placed such that a back surface of the packing sheet S1 faced and contacted the matte clear coating film of one building board B2. Next, the other building board B2 was stacked on top of the one building board B2 with the packing sheet S1 interposed between the other building board B2 and the one building board B2. The other building board B2 was placed such that the matte clear coating film thereof faced and contacted the other surface of the packing sheet S1. In the above-described manner, a package having the same stacked configuration as that shown in FIG. 6 was produced.

Comparative Example 3

A package of Comparative Example 3 was produced in the same manner as in the case of the package of Example 3 except that the packing sheet S4 was used in place of the packing sheet S1.

Example 4

Production of Building Board

First, an acrylic coating material was applied to a flat patterned design surface of an inorganic board (1820 mm×470 mm×16 mm, 17 kg), and was then dried, to form an intermediate coating film having a thickness of 40 μm. Next, a silicone-acrylic coating material containing no resin beads was applied onto the intermediate coating film, to form a coating film. Then, the coating film was dried, to form a glossy clear coating film having a thickness of 5 μm. In the above-described manner, two building boards B3 each including a glossy clear coating film on one surface thereof were produced.

Production of Package

First, a packing sheet S5 (thickness: 60 μm, a polyethylene film) was placed such that a back surface of the packing sheet S5 faced and contacted the glossy clear coating film of one building board B3. The packing sheet S5 had been subjected to embossing, and has, on a front surface thereof, a roughness profile including a plurality of minute protrusions (uniformly disposed) formed through the embossing, and has, on a back surface thereof, a roughness profile including a plurality of minute recesses at position respectively corresponding to the plurality of minute protrusions. Specifically, on the front surface of the packing sheet S5, minute protrusion each having a top surface with a diamond shape of about 4×2 mm and having a height of 70 μm are disposed substantially equidistantly in a zig-zag pattern, thus forming uniform roughness. On each of the top surfaces of the minute protrusions, a plurality of further minute protrusions each having an ellipsoidal shape of about 300×500 μm are formed, thus forming roughness. On the back surface of the packing sheet S5, minute recesses each having a diamond shape are disposed substantially equidistantly in a zig-zag pattern at positions respectively corresponding to the minute protrusions, thus forming uniform roughness. Next, the other building board B3 was stacked on top of the one building board B3 with the packing sheet S5 interposed between the other building board B3 and the one building board B3. The other building board B3 was placed such that the glossy clear coating film thereof faced and contacted the other surface of the packing sheet S5. In the above-described manner, a package having the same stacked configuration as that shown in FIG. 6 was produced.

Comparative Examples 4 to 6

Packages of Comparative Examples 4 to 6 were produced in the same manner as in the case of the package of Example 4 except that the packing sheet S4 (Comparative Example 4), a packing sheet S6 (Comparative Example 5), or a packing sheet S7 (Comparative Example 6) was used in place of the packing sheet S5.

The packing sheet S6 is a non-stretched polypropylene sheet (thickness: 100 μm).

The packing sheet S7 is a packing sheet (thickness: 76 μm) obtained by forming a polyethylene film containing calcium carbonate fine particles into a tubular shape.

Measurement of Gloss Values

For the surface of each of the matte clear coating films of the building boards B1 and B2, the surface of the glossy clear coating film of the building board B3, and the front surface and the back surface of each of the packing sheets S1 to S7, the 60-degree gloss value and the 85-degree gloss value were measured in accordance with JIS Z 8741. For this measurement, a gloss meter (product name "micro-TRI-gloss with standard holder, model 4430", manufactured by BYK Gardner GmbH) was used.

For the surface of the matte clear coating film of the building board B1, the 60-degree gloss value $G_{60}$ was 4.0, and the 85-degree gloss value $G_{85}$ was 1.7. For the surface of the matte clear coating film of the building board B2, the 60-degree gloss value $G_{60}$ was 3.3, and the 85-degree gloss value $G_{85}$ was 3.2. For the surface of the glossy clear coating film of the building board B3, the 60-degree gloss value $G_{60}$ was 12.7, and the 85-degree gloss value $G_{85}$ was 12.8.

For each of Examples 1 to 4 and Comparative Examples 1 to 6, the 60-degree gloss value $G_{60}$ of each of the front surface and the back surface of the packing sheet used, the 85-degree gloss value $G_{85}$ of each of the front surface and the back surface of the packing sheet used, the absolute value $\Delta G_{60}$ of a difference in 60-degree gloss value between the surface of the coating film of the building board and the front surface or the back surface of the packing sheet, and the absolute value $\Delta G_{85}$ of a difference in 85-degree gloss value between the surface of the coating film of the building board and the front surface or the back surface of the packing sheet are shown in Table 1.

Evaluation of Generation of Gloss

For each of the packages of Examples 1 to 4 and Comparative Examples 1 to 6, generation of gloss on the surface of the coating film of the building board was evaluated in the following manner. First, 25 packages were stacked in multiple tiers. Next, after 24 hours, the packages were unpacked, and the surface of the coating film of each of the building boards of the package disposed in the lowermost tier was visually observed to check whether or not a new gloss has been generated. The results are shown in Table 1.

TABLE 1

| | Measurement target for gloss value | 60-degree gloss value $G_{60}$ | 85-degree gloss value $G_{85}$ | $\Delta G_{60}$ | $\Delta G_{85}$ | Visual evaluation |
|---|---|---|---|---|---|---|
| Example 1 | Front surface side of packing sheet S1 | 5.6 | 4.6 | 1.6 | 2.9 | No gloss confirmed |
| | Back surface side of packing sheet S1 | 3.4 | 0.9 | 0.6 | 0.8 | No gloss confirmed |
| Example 2 | Front surface side of packing sheet S2 | 4.4 | 9.9 | 0.4 | 8.2 | Gloss confirmed |
| | Back surface side of packing sheet S2 | 5.2 | 3.3 | 1.2 | 1.6 | No gloss confirmed |
| Com. Ex. 1 | Front surface side of packing sheet S3 | 10.0 | 23.4 | 6.0 | 21.7 | Gloss confirmed |
| | Back surface side of packing sheet S3 | 10.0 | 23.4 | 6.0 | 21.7 | Gloss confirmed |
| Com. Ex. 2 | Front surface side of packing sheet S4 | 5.7 | 9.6 | 1.7 | 7.9 | Gloss confirmed |
| | Back surface side of packing sheet S4 | 5.7 | 9.6 | 1.7 | 7.9 | Gloss confirmed |
| Example 3 | Front surface side of packing sheet S1 | 5.6 | 4.6 | 2.3 | 1.4 | No gloss confirmed |
| | Back surface side of packing sheet S1 | 3.4 | 0.9 | 0.1 | 2.3 | No gloss confirmed |
| Com. Ex. 3 | Front surface side of packing sheet S4 | 5.7 | 9.6 | 2.4 | 6.4 | Gloss confirmed |
| | Back surface side of packing sheet S4 | 5.7 | 9.6 | 2.4 | 6.4 | Gloss confirmed |
| Example 4 | Front surface side of packing sheet S5 | 13.5 | 10.9 | 0.8 | 1.9 | No gloss confirmed |
| | Back surface side of packing sheet S5 | 12.4 | 13.6 | 0.3 | 0.8 | No gloss confirmed |
| Com. Ex. 4 | Front surface side of packing sheet S4 | 5.7 | 9.6 | 7.0 | 3.2 | Loss of gloss occurred |
| | Back surface side of packing sheet S4 | 5.7 | 9.6 | 7.0 | 3.2 | Loss of gloss occurred |
| Com. Ex. 5 | Front surface side of packing sheet S6 | 49.5 | 42.2 | 36.8 | 29.4 | Gloss confirmed |
| | Back surface side of packing sheet S6 | 49.5 | 42.2 | 36.8 | 29.4 | Gloss confirmed |
| Com. Ex. 6 | Front surface side of packing sheet S7 | 10.0 | 44.0 | 2.7 | 31.2 | Gloss confirmed |
| | Back surface side of packing sheet S7 | 10.0 | 44.0 | 2.7 | 31.2 | Gloss confirmed |

In Example 1, the absolute value $G_{60}$ of the difference in 60-degree gloss value and the absolute value $G_{85}$ of the difference in 85-degree gloss value between the surface of the coating film of the building board B1 and the front surface of the packing sheet S1 were both 3.0 or less, and generation of a new gloss was not confirmed on the surface of the coating film of the building board B1 disposed on the front surface side of the packing sheet S1. In addition, in Example 1, the absolute value $G_{60}$ of the difference in 60-degree gloss value and the absolute value $G_{85}$ of the difference in 85-degree gloss value between the surface of the coating film of the building board B1 and the back surface of the packing sheet S1 were both 3.0 or less, and generation of a new gloss was not confirmed on the surface of the coating film of the building board B1 disposed on the back surface side of the packing sheet S1.

In Example 2, the absolute value $G_{60}$ of the difference in 60-degree gloss value and the absolute value $G_{85}$ of the difference in 85-degree gloss value between the surface of the coating film of the building board B1 and the back surface of the packing sheet S2 were both 3.0 or less, and generation of a new gloss was not confirmed on the surface of the coating film of the building board B1 disposed on the back surface side of the packing sheet S2.

In Example 3, the absolute value $G_{60}$ of the difference in 60-degree gloss value and the absolute value $G_{85}$ of the difference in 85-degree gloss value between the surface of the coating film of the building board B2 and the front surface of the packing sheet S1 were both 3.0 or less, and generation of a new gloss was not confirmed on the surface of the coating film of the building board B2 disposed on the front surface side of the packing sheet S1. In addition, in Example 3, the absolute value $G_{60}$ of the difference in 60-degree gloss value and the absolute value $G_{85}$, of the difference in 85-degree gloss value between the surface of the coating film of the building board B2 and the back surface of the packing sheet S1 were both 3.0 or less, and generation of a new gloss was not confirmed on the surface of the coating film of the building board B2 disposed on the back surface side of the packing sheet S1.

In Example 4, the absolute value $G_{60}$ of the difference in 60-degree gloss value and the absolute value $G_{85}$ of the difference in 85-degree gloss value between the surface of the coating film of the building board B3 and the front surface of the packing sheet S5 were both 3.0 or less, and generation of a new gloss was not confirmed on the surface of the coating film of the building board B3 disposed on the front surface side of the packing sheet S5. In addition, in Example 4, the absolute value $G_{60}$ of the difference in 60-degree gloss value and the absolute value $G_{85}$ of the difference in 85-degree gloss value between the surface of the coating film of the building board B3 and the back surface of the packing sheet S5 were both 3.0 or less, and generation of a new gloss was not confirmed on the surface of the coating film of the building board B3 disposed on the back surface side of the packing sheet S5.

LIST OF REFERENCE NUMERALS

X1, X2 Package
10 First building board
11 First surface
11A First coating film
12 Second surface
20 Packing sheet
21 Third surface
22 Fourth surface
30 First building board
31 Fifth surface
31A Second coating film
32 Sixth surface

The invention claimed is:

1. A building board package comprising:

a first building board; and a packing sheet stacked on top of the first building board, wherein the first building board has a first surface including a first coating film surface, and a second surface opposite the first surface, the packing sheet has a third surface on the first building board side, and a fourth surface opposite the third surface, the third surface is in contact with the first coating film surface, and an absolute value of a difference between a 60-degree gloss value of the first coating film surface and a 60-degree gloss value of the third surface is 3.0 or less, and an absolute value of a difference between an 85-degree gloss value of the first coating film surface and an 85-degree gloss value of the third surface is 3.0 or less.

2. The building board package according to claim 1, further comprising a second building board stacked on top of the first building board with the packing sheet interposed between the second building board and the first building board, wherein the second building board has a fifth surface on the first building board side, and a sixth surface opposite the fifth surface, and the fifth surface includes a second coating film surface, the fourth surface of the packing sheet on the second building board side is in contact with the second coating film surface, and an absolute value of a difference between a 60-degree gloss value of the second coating film surface and a 60-degree gloss value of the fourth surface is 3.0 or less, and an absolute value of a difference between an 85-degree gloss value of the second coating film surface and an 85-degree gloss value of the fourth surface is 3.0 or less.

3. The building board package according to claim 1, wherein the third surface has a roughness profile in which a plurality of minute protrusions protruding to the first building board side are uniformly disposed.

4. The building board package according to claim 2, wherein the third surface has a roughness profile in which a plurality of minute protrusions protruding to the first building board side are uniformly disposed, and the fourth surface has a roughness profile including a plurality of minute recesses at positions respectively corresponding to the plurality of minute protrusions.

5. A method for manufacturing a building board package, comprising the steps of:

preparing a first building board having a first surface including a first coating film surface and a second surface opposite the first surface, and a packing sheet having a third surface and a fourth surface opposite the third surface; and stacking the first building board and the packing sheet on top of each other such that the first coating film surface and the third surface are in contact with each other, wherein an absolute value of a difference between a 60-degree gloss value of the first coating film surface and a 60-degree gloss value of the third surface is 3.0 or less, and an absolute value of a difference between an 85-degree gloss value of the first coating film surface and an 85-degree gloss value of the third surface is 3.0 or less.

6. The method for manufacturing a building board package according to claim 5, further comprising a step of stacking a second building board having a fifth surface including a second coating film surface, and a sixth surface opposite the fifth surface, on top of the first building board with the packing sheet interposed between the second building board and the first building board such that the second coating film surface and the fourth surface of the packing sheet are in contact with each other, wherein an absolute value of a difference between a 60-degree gloss value of the second coating film surface and a 60-degree gloss value of the fourth surface is 3.0 or less, and an absolute value of a difference between an 85-degree gloss value of the second coating film surface and an 85-degree gloss value of the fourth surface is 3.0 or less.

7. The method for manufacturing a building board package according to claim 5, wherein the third surface has a roughness profile in which a plurality of minute protrusions protruding to the first building board side are uniformly disposed.

8. The method for manufacturing a building board package according to claim 6, wherein the third surface has a roughness profile in which a plurality of minute protrusions protruding to the first building board side are uniformly disposed, and the fourth surface has a roughness profile including a plurality of minute recesses at positions respectively corresponding to the plurality of minute protrusions.

* * * * *